United States Patent [19]

Heit et al.

[11] 3,968,983

[45] July 13, 1976

[54] TWO POSITION, THREE FUNCTION LATCHING MECHANISM

[75] Inventors: Henry J. Heit; Raymond L. Dills, both of Louisville, Ky.

[73] Assignee: General Electric Company, Louisville, Ky.

[22] Filed: July 2, 1975

[21] Appl. No.: 592,546

[52] U.S. Cl. ..... 292/201; 292/DIG. 69; 292/52; 126/197

[51] Int. Cl.[2] ..... E05C 3/34

[58] Field of Search ..... 292/DIG. 69, 201, 46, 292/48, 52, 45, 126; 126/197

[56] References Cited

UNITED STATES PATENTS

| | | | |
|---|---|---|---|
| 3,069,889 | 12/1962 | Johnstone et al. | 292/DIG. 24 |
| 3,367,697 | 2/1968 | Fox, Sr. | 292/113 |
| 3,750,643 | 8/1973 | Fowler et al. | 126/197 |

*Primary Examiner*—Richard E. Moore
*Attorney, Agent, or Firm*—Richard L. Caslin; Francis H. Boos

[57] ABSTRACT

A sliding latch mechanism for the door of a heated cavity, such as a microwave oven that is provided with a pyrolytic self-cleaning oven cycle. This latch mechanism has a handle with only two positions; namely, a first unlatched position and a second latched position. The second latched position has two separate modes or functions; namely, an unlocked function and a locked function. The first unlatched position of the handle may be considered as providing an unlatched function. This first unlatched position of the handle is used for opening the door when needed, or when cooking within the oven with standard radiant heating means. The second latched position of the handle in its unlocked mode is used for microwave cooking alone or for combined microwave and radiant cooking. The second latched position of the handle in its locked mode is used during the pyrolytic self-cleaning oven cycle when the oven door should not be opened or capable of being opened when the oven temperature is above normal cooking temperatures in the self-cleaning temperature range.

7 Claims, 7 Drawing Figures

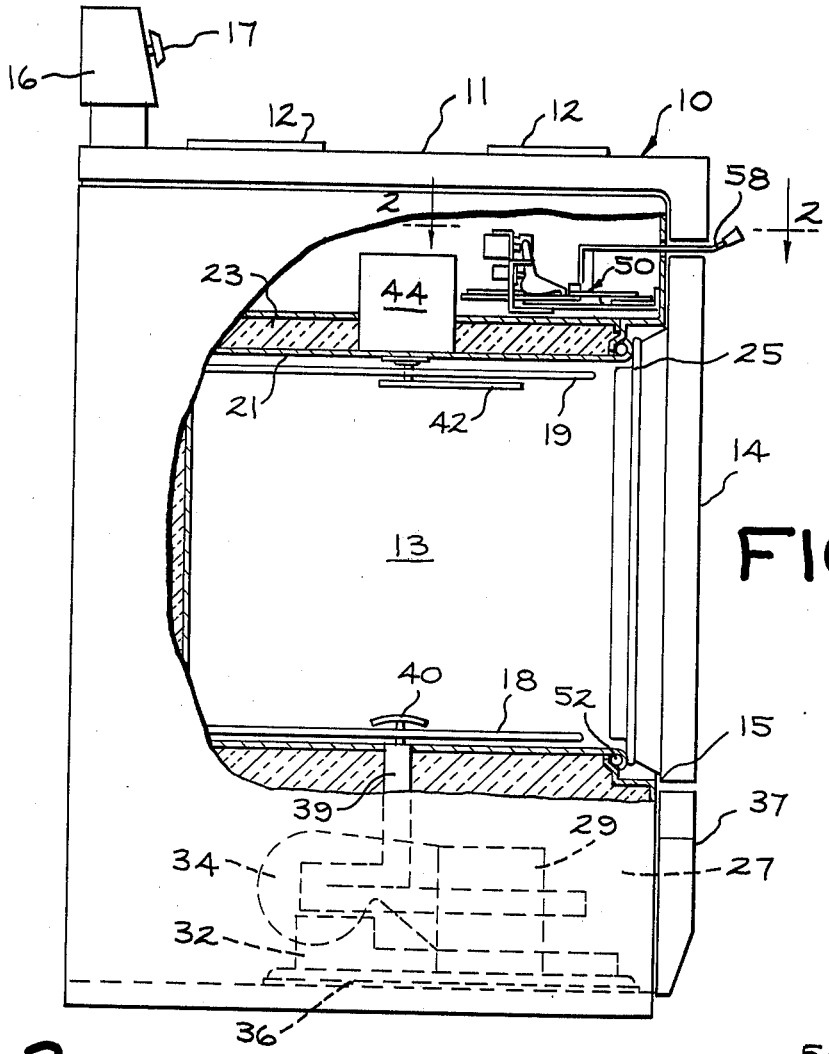
FIG. 1
FIG. 2
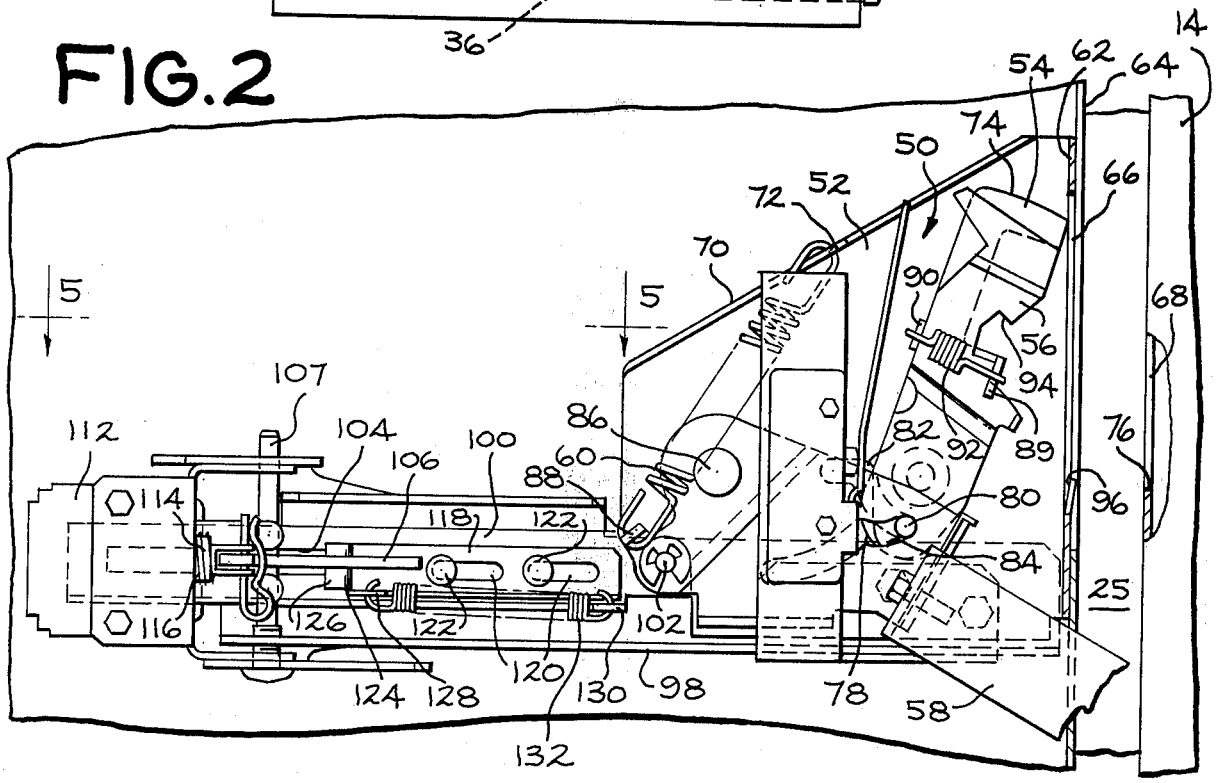

TWO POSITION, THREE FUNCTION LATCHING MECHANISM

BACKGROUND OF THE INVENTION

1. Field of the Invention

The invention relates to a door latching system and particularly to one having a combined latch and operator for use with the doors of heated cavities, such as microwave ovens.

2. Description of the Prior Art

This invention was especially designed for a door latching system for a microwave oven that has the added convenience of a pyrolytic self-cleaning oven cycle by use of radiant heating means. It is imperative that a microwave oven have its door latched closed during its operation so as to prevent the leakage or direct exposure to microwave radiation from within the oven cooking cavity. When the oven door is unlatched and opened, the microwave energy is first automatically deenergized within the oven. There is a similar latching requirement for pyrolytic self-cleaning ovens; that is, the oven door must be closed and latched shut during the cleaning cycle, especially at temperatures above about 600°F as is explained in the U.S. Reissue Pat. No. Re. 26,944 of Clarence Getman, which is assigned to the assignee of the present invention. The microwave oven door may be unlatched at any time in the operation of the oven, but a self-cleaning oven should not be capable of being unlatched until the oven temperature drops below about 600°F. Thus the latching mechanism in its self-cleaning mode is provided with a locking means.

The present invention is a modification of the latch mechanism that is described in U.S. Pat. No. 3,750,643 of Roland V. Fowler, James A. White and David C. Cross, which is assigned to the present assignee. This patented latch mechanism is a three position latch having a pivoted handle with an extreme unlatched position, an intermediate latched position for microwave operation, and an opposite extreme latched position that is locked during the self-cleaning cycle. Because the handle of this patented latch mechanism has an intermediate position, it would in this intermediate position ordinarily protrude from the front of the oven and create a hazard. The patented latch mechanism has a special pivot arrangement for providing the outermost end of the latch handle with a flattened arc of travel so it does not constitute an obstruction in its intermediate position.

The present invention has greatly simplified the latch construction by converting it to a two position latch mechanism having three functions or modes. An electroresponsive means is employed to discriminate between the latched and the latched/locked functions.

It has been found expedient to provide separate door interlock switches and circuits for operation during the latched functions and the latched/locked function for discriminating between the microwave cooking operation and the pyrolytic self-cleaning oven cycle so as to simplify the control circuits and reduce the total cost of electrical components.

SUMMARY OF THE INVENTION

A two position, three function latch mechanism with a base and a latch handle pivoted to the base is provided. A latching bolt is also pivotally connected to both the base and the latch handle so that movement of the latch handle causes a turning action of the latching bolt. A locking bar is pivotally connected to the latch handle and it cooperates with a lock means for holding the latching mechanism against further movement. Release means for disabling the lock means enables the latch handle to be shifted. A shutter means is associated with the locking bar for supporting the lock means and keeping it from engaging the locking bar in the second position of the latch handle that is latched but unlocked. This shutter means is set in a cocked position by the lock means when the latch handle is moved to its latched position, whereby the operation of the release means causes the shutter to trip so the lock means may engage the locking bar in the second latched and locked position.

The principal object of the present invention is to provide a two position, three function sliding latch mechanism having a first unlatched position, a second latched but unlocked position, and a second latched and locked position.

A further object of the present invention is to provide a latch mechanism of the class described with the ability to move the latch handle at will in and out of the second latched but unlocked position.

A further object of the present invention is to provide a latch mechanism of the class described with the ability to render the latch mechanism temporarily immovable when the latch handle is in its second latched and locked position.

BRIEF DESCRIPTION OF THE DRAWINGS

Our invention will be better understood from the following description taken in conjunction with the accompanying drawings and its scope will be pointed out in the appended claims.

FIG. 1 is a right side elevational view of a free-standing electric range having a microwave oven that is equipped with the two position, three function sliding latch mechanism of the present invention for the oven door.

FIG. 2 is a fragmentary plan view on an enlarged scale taken on the line 2—2 of FIG. 1 to show the oven door latching mechanism of the present invention in its first unlatched or open position so the oven door may be opened and closed at will.

DESCRIPTION OF THE PREFERRED EMBODIMENT

Figure 3:
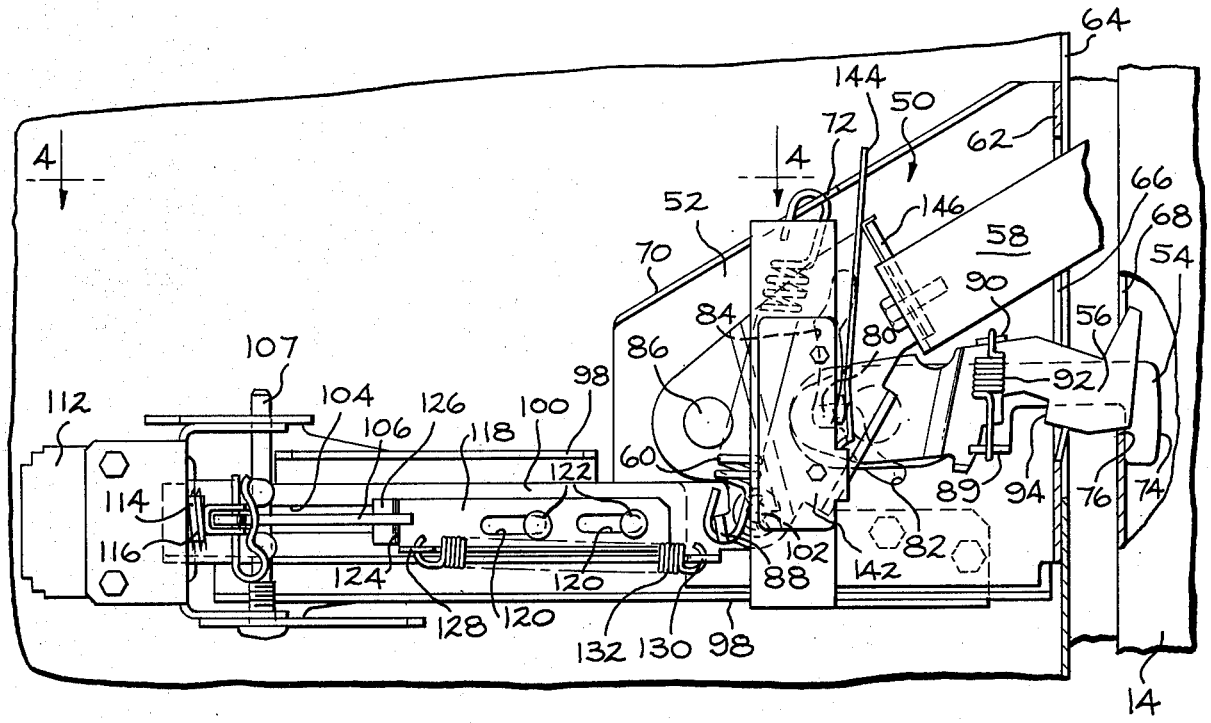
FIG. 3 is another plan view of the latch mechanism, similar to that of FIG. 2, except the latch handle has been moved to its second latched but unlocked position, as would be used for microwave cooking.

Turning now to a consideration of the drawings, and in particular to FIG. 1, there is shown for illustrative purposes a free-standing electric range 10 having a top cooking surface 11 with a plurality of surface heating elements 12, an oven cooking cavity 13 beneath the top cooking surface, a front-opening oven door 14 hinged along its bottom edge 15, and a backsplash 16 arranged along the back edge of the cooking surface 11 and including in its front face a control panel with all of the manual and visual control components 17 mounted therein for governing the energization of the various heating means of the range. The oven cooking cavity 13 includes the two standard electric heating elements; namely, a lower bake element 18 arranged along the bottom wall of the box-like oven liner 21, and an upper broil unit 19 which is located adjacent to the top wall of the oven liner. As in conventional electric ovens, there is a layer 23 of thermal insulation, such as fiber glass, surrounding the walls of the oven liner 21 for retaining the heat generated within the cooking cavity 13. Moreover, the oven door 14 is an insulated door construction so as not to allow excessively high temperatures to exist on the outer surface of the door. The oven door requires a special door sealing arrangement on its inner surface in the vicinity of the door gap with relation to the front flange of the oven liner 21 in the area marked 25 to prevent both microwave leakage during microwave cooking and smoke, odor, vapor and thermal leakage during the self-cleaning cycle. Since this door gasketing does not form part of the present invention, it has not been illustrated nor described in detail.

The microwave features of the oven will now be described briefly with reference to FIG. 1. Beneath the oven 13 is a compartment 27, which in an ordinary range would be a drawer space, but in this particular range would be a housing for a magnetron tube microwave generator 29 in combination with a power supply 32, and blower 34 for cooling the magnetron and power supply components under operating conditions. These three subassemblies are mounted on a pull-out tray 36 which is provided at its front edge with a vertical panel 37 which conforms to the appearance of the oven door 14 and serves to close the apparatus compartment 27 and to appear as a drawer structure. In other words, the movable tray 36 serves as the bottom wall of the drawer-like member which is without sidewalls for gaining ready access to the magnetron, power supply and blower. A coaxial transmission line 39 rises vertically from the magnetron generator 29 and extends through the bottom wall of the oven liner 21, generally in the center thereof. An antenna 40 is mounted from the transmission line just above the bottom wall of the oven liner 21 for propagating the microwave energy throughout the oven cooking cavity 13.

In order to obtain uniform cooking results, a mode stirrer or parasitic exciter 42 is assembled adjacent the top wall of the oven liner generally centered above the antenna 40, and it is mounted on a shaft that extends through the top wall of the oven liner for connection to a motor and gear drive assembly 44. The stationary antenna 40 serves to set up a basic TE 131 mode which excites complementary TE 122 modes in the mode stirrer or parasitic exciter 42. There would be a metal rack (not shown here) suspended between the side walls of the oven liner for supporting food to be cooked within the oven cooking cavity 13.

The door latching mechanism of the present invention is indicated by the numeral 50 in FIG. 1, and it is preferably located within the oven cabinet or range body above the door opening and above the top layer of thermal insulation 23. As mentioned previously, the use of a door latch mechanism of some kind has been found of primary importance in the operation of a high temperature, pyrolytic self-cleaning oven. In such an oven there may be provided, in addition to the lower bake element 18 and the upper broil element 19, a third heating element or a mullion heater 52 as seen in FIG. 1, that is located near the door opening of oven liner 21 to encircle the oven liner, or at least part of it, to compensate for the loss of heat through and around the oven door 14 so as to obtain generally uniform temperature distribution.

Referring particularly to FIG. 2, the front half of the latch mechanism 50 shown at the right side of the FIGURE, is generally as shown in U.S. Pat. No. 3,367,697 of Joseph S. Fox, Sr., which is assigned to the same assignee as is the present invention. The latch mechanism 50 comprises the following main elements; a base plate 52, a pivoted latching bolt 54, a door sensor bar 56 that is carried piggy-back on the latching bolt, a pivoted latch handle 58, and an overcenter tension spring 60 that is joined at one end to the base plate and at its other end to the latch handle.

The base plate 52 is generally of flat sheet metal configuration with an upturned vertical front flange 62 that is adapted to be fastened against the inner surface of the front door frame 64 of the oven body. Both this flange 62 and the front frame 64 of the oven body have a horizontal elongated slot 66 which generally coincides with a similar shaped slot or latch keeper 68 so that the pivoted latching bolt 54 and its door sensor bar 56 may move in and out of the oven body for engaging the keeper 68 of the door and holding it latched. The base plate 52 has a second upturned vertical flange 70 along one side thereof to which one end of the tension spring 60 is anchored, as at 72.

The pivoted latching bolt 54 is an elongated metal stamping with a front hook formation 74 for engaging one edge 76 of the keeper slot 68 of the door 14. The opposite end 78 of the latching bolt 54 has a vertical through pin 80 extending above and below the bolt 54. The pin 80 below the bolt travels in an elongated Z shaped cam slot 82 in the base plate 52, while the pin 80 above the bolt travels in an elongated crooked cam slot 84 of the latch handle 58, so that there is in effect a lost motion connection between the latch handle 58 and the latching bolt 54, as well as between the latching bolt and the base plate 52.

The latch handle 58 is pivoted to the base plate 52 by a vertical pivot pin 86. A vertical tab 88 is formed upwardly on the latch handle, near the pivot pin 86, and it serves as an anchor point for the other end of the overcenter tension spring 60.

The door sensor bar 56 overlies the latching bolt 54 and is pivoted about the portion of the pin 80 that extends above the latching bolt 54. The latching bolt 54 has an upturned tab 89 that rises above the door sensor bar 56. The opposite edge of the door sensor bar 56 has an upturned tab 90, and there is a tension spring 92 connected between the two tabs which tends to hold the sensor bar 56 against the tab 89. Notice that the door sensor bar 56 overlies the hook portion 74 of the latching bolt 54. The door sensor bar 56 also has a hook portion 94 of its own. If the door 14 is not fully closed before the latch handle 58 is moved from the unlatched position of FIG. 2 toward the latched position of FIG. 3, the hook portion 94 of the door sensor bar 56 will engage the edge 96 of the slot 66 in the oven front frame 64 and thereby prevent the latch handle from reaching the second latched position of FIG. 3. If the door 14 is closed, and the latch handle is moved to its latched position, the door sensor bar will be deflected by the edge 76 of the door keeper slot 68 so the latch handle would be able to reach its second latched position.

The base plate 52 includes a channel-shaped rearward extension 98 in which is supported for sliding action an elongated locking bar 100. This locking bar 100 is connected to the latch handle 58 by means of a vertical pivot pin 102 such that pivotal movement of the latch handle 58 causes rectilinear movement of the locking bar 100. An elongated slot 104 is formed in the locking bar 100 near the rear end thereof. This slot 104 cooperates with a pivoted lock bolt 106 for locking the door latch mechanism 50 in the second latched position of FIG. 7. This lock bolt 106 is a flat vertical plate that is pivoted about a horizontal hinge pin 107. The lock bolt 106 has a downward extending finger 108 that is adapted to move vertically in and out of the slot 104 of the locking bar. When the finger is in the slot 104, the latch handle 58 is in its second latched position and locked in place so the latch mechanism can not be unlatched. If an attempt were made to shift the latch handle, the locking bar 100 would start to slide rearward but the finger 108 would strike the end 110 of the slot 104 and prevent further movement.

Figure 7:
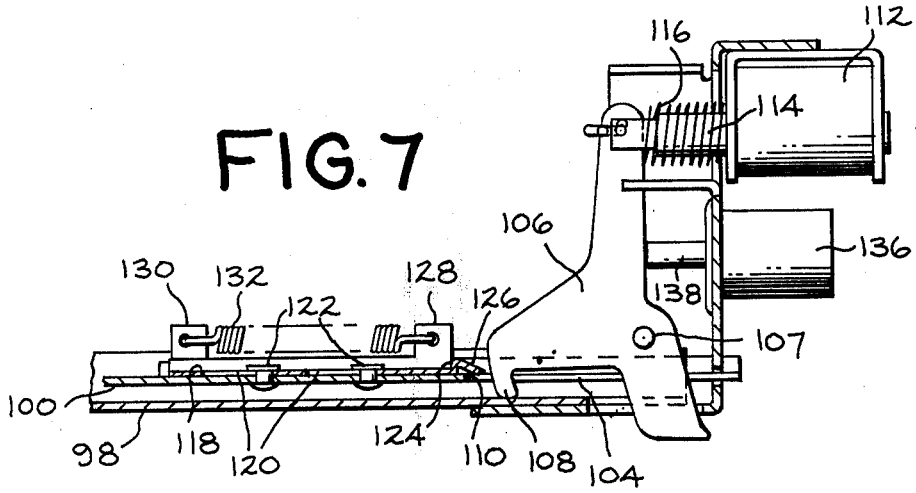
FIG. 7 is a fragmentary elevational view similar to that of FIG. 6 after the solenoid is deenergized, showing the pivoted lock means lowered into locking engagement with the locking bar, which is the second latched and locked position of the latch mechanism, as for use during the self-cleaning oven cycle.

The raising and the lowering of the finger 108 is caused by the action of a solenoid 112 that has a horizontally acting armature 114 which is drawn into the solenoid when the solenoid is energized. This sliding action of the armature causes the lock bolt 106 to pivot about its hinge pin 107 in a clockwise direction so as to raise the downwardly extending finger 108 out of the slot 104 in the locking bar 100. A compression spring 116 cooperates with the armature so that when the solenoid is deenergized the lock bolt 106 will be urged in a counterclockwise direction about its hinge pin 107 as seen in FIG. 7. A momentary switch (not shown) would be in series circuit with the solenoid 112 to operate the solenoid only briefly. This combination of locking bar 100, lock bolt 106 and solenoid 112 is generally the same as described in the forementioned U.S. Pat. No. 3,750,643.

Turning back to the plan view of FIG. 2, a sliding plate or shutter 118 is carried on the top of the locking bar 100. Two elongated slots 120 are formed longitudinally in the shutter, each for receiving a rivet fastener 122 that is carried by the locking bar 100 so as to form a lost motion connection and guiding means for the sliding action of the shutter 118 on the locking bar 100. The rearmost end 124 of the shutter 118 is provided with a raised stop means 124 that has a downwardly sloping tip 126. The shutter includes a raised tab 128 and the locking bar has a complementary raised tab 130 that is widely spaced from the other tab. A tension spring 132 is fastened between the two tabs 128 and 130 so the shutter 118 is normally held in its frontmost position shown in FIG. 2 as the first unlatched position of the latching mechanism. Notice in the complementary elevational view of FIG. 5 that the finger 108 of the lock bolt 106 is resting on the top surface of the shutter.

Figure 4:
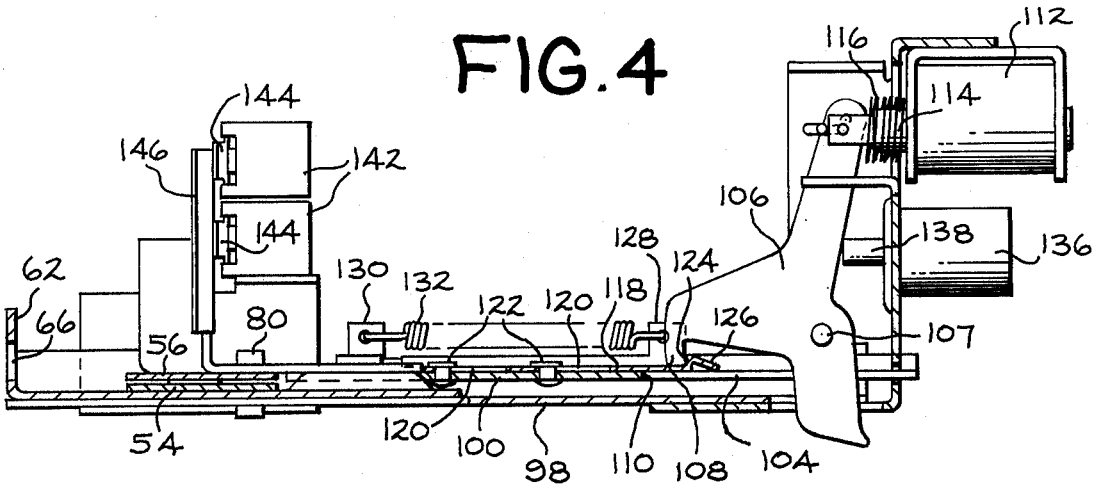
FIG. 4 is a fragmentary elevational view of the rear portion of the latch mechanism, taken on the line 4—4 of FIG. 3, with the latch handle in its second latched but unlocked position.

Now compare FIGS. 3 and 4 when the latch handle is shifted from the unlatched position of FIG. 2 to the latched position of FIG. 3. The main change is that the locking bar 100 has shifted toward the front of the oven so that the slot 104 is positioned for the first time beneath the finger 108 of the lock bolt 106. At the same time the shutter is cocked by the action of the finger 108 bearing against the stop means 124 of the shutter and preventing the shutter from moving forward with the locking bar 100, while at the same time stressing the tension spring 132. Notice in FIG. 4 that the position of the shutter serves to support the finger 108 of lock bolt 106 out of engagement with the slot 104 of the locking bar 100. This is the second position of the latching mechanism 50 when the mechanism is latched but in its unlocked mode.

Figure 5:
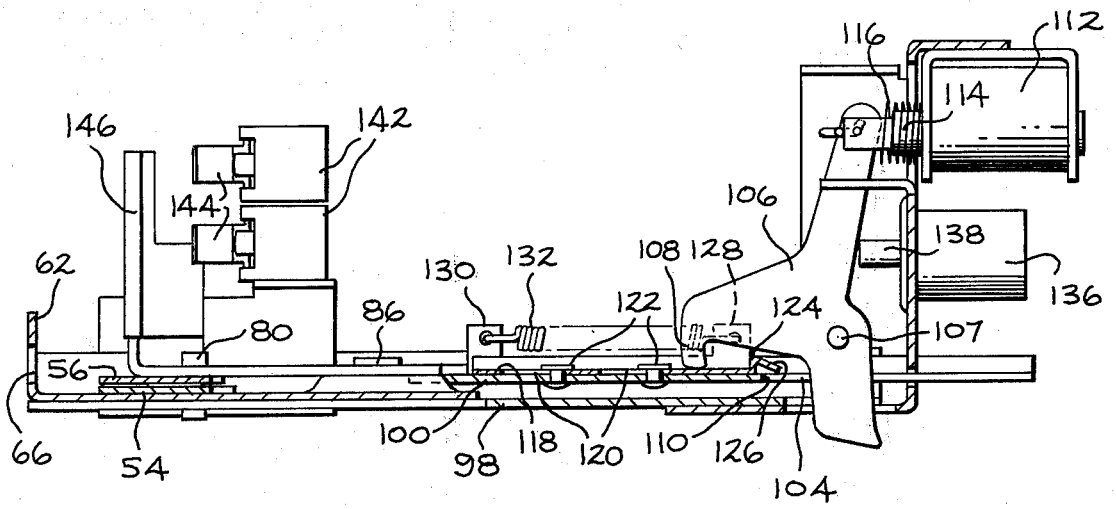
FIG. 5 is a fragmentary elevational view similar to that of FIG. 4, taken on the line 5—5 of FIG. 2, with the latch handle in its first unlatched or open position.
Figure 6:
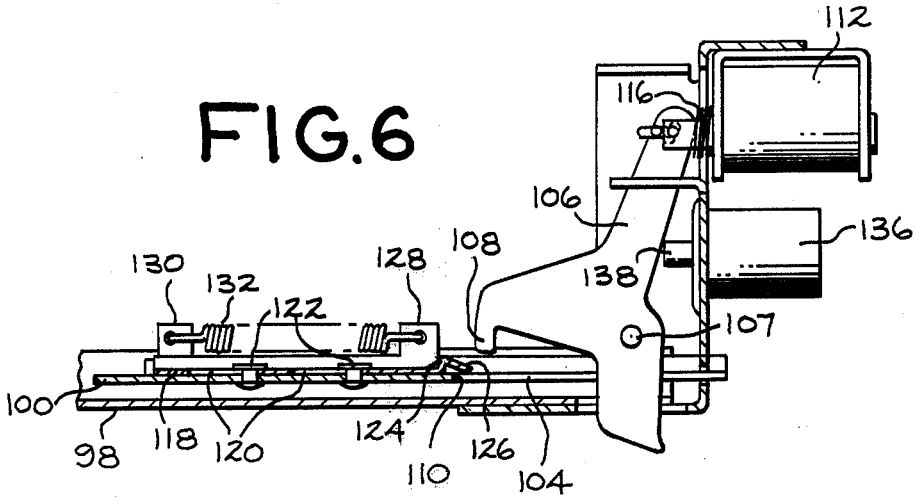
FIG. 6 is a fragmentary elevational view similar to that of FIG. 4, showing the pivoted lock means raised by the action of a solenoid to release or trip the shutter which is pulled out from under the lock means.

Now comparing FIGS. 4 and 5, when the solenoid 112 is energized the lock bolt 106 is tilted clockwise in FIG. 6 which raises the finger 108 above the stop means 124 which releases or trips the shutter causing it to move with a snap action to the forward position of FIGS. 6 and 7. Then when the solenoid is deenergized the return spring 116 of the solenoid causes the lock bolt 106 to pivot forwardly, thereby dropping the finger 108 into the slot 104 of the locking bar 100. This action serves as a locking function for the door latching mechanism as for use in the self-cleaning oven mode, especially at temperatures above the maximum cooking temperatures of about 600°F. Connected in series circuit with the solenoid 112 would be a thermal or time-activated switch (not shown) which would open-circuit the solenoid circuit at temperature above 600°F as is described in the Barber-Reissue U.S. Pat. No. 26,943 and the Getman-Reissue U.S. Pat. No. 26,944.

A normally-open interlock switch 136 is positioned beneath the solenoid, and it has a plunger 138 that bears against the lock bolt 108 at all times. Looking at the latched/locked position of FIG. 7 the interlock switch is closed when the finger 108 engages in the slot 104 to serve as a "proof of lock" means. This interlock switch 136 would be in the control circuit for the self-cleaning oven cycle, so the self-cleaning cycle could not be initiated until the door is closed, the latch handle 58 is in the latched position, and the latching mechanism 50 is locked by the lock bolt 106.

Looking at the plan view of FIG. 3, a pair of vertically stacked microwave interlock switches 142 are shown mounted above the latch handle 58. The switches are microswitches that carry a cantilever actuator bar 144 for each. The latch handle 58 includes a raised flange 146 for engaging the actuator bars 144 and closing the interlock switches 142 when the latch handle is in its latched position of FIGS. 3 and 4.

These interlock switches 142 would be connected in the control circuit for the microwave energy generating system such that the microwave generator is automatically deenergized whenever the latch mechanism 50 is unlatched.

The present invention relates to the door latching mechanism 50, rather than to the control and power circuits for the radiant heaters and the microwave heating means. Accordingly, these circuits are not described in detail here as they do not form part of the present invention.

Modifications of this invention will occur to those skilled in this art, therefore, it is to be understood that this invention is not limited to the particular embodiments disclosed but that it is intended to cover all modifications which are within the true spirit and scope of this invention as claimed.

We claim:

1. A two position three function sliding latch mechanism comprising a base, a latch handle pivotally connected to the base, a latching bolt pivotally connected to the base and joined to both the latch handle and the base by lost motion means whereby movement of the latch handle toward and away from a first unlatched position causes a turning action of the latching bolt, and a locking bar pivotally connected to the latch handle and movable in response thereto, lock means associated with the locking bar for engaging the locking bar and holding the latching mechanism against further movement when the latch handle is in its second latched and locked position, and operating means for controlling the lock means so the handle lever may be shifted toward the first unlatched position, and shutter means associated with the locking bar for supporting the lock means and keeping the lock means from engaging the locking bar in a second latched but unlocked position, said shutter means being set into a cocked position by the lock means when the latch handle is moved from the first unlatched position into the second latched but unlocked position, whereby when the lock means is shifted by the operating means the shutter is released causing it to trip and move away from the lock means so the lock means may engage the locking bar as in the second latched and locked position.

2. A two position three function sliding latch mechanism as recited in claim 1 wherein the said locking bar includes slot means for receiving the lock means therein and rendering the locking bar substantially immovable in the second latched and locked position.

3. A two position three function sliding latch mechanism as recited in claim 2 wherein the said shutter is slidably mounted on the locking bar so that it is capable of covering at least part of said slot means when the shutter is cocked so as to support the lock means when the latch handle is in its second latched but unlocked position, and spring means acting on the shutter in its cocked position for tripping the shutter and uncovering the slot means when the lock means it operated by the manually operable means.

4. A two position three function sliding latch mechanism as recited in claim 3 wherein the said shutter is provided with a stop means at its end nearest the lock means which is engagable by the lock means so the shutter may be cocked when the latch handle is moved from the first unlatched position to the second latched but unlocked position.

5. A two position three function sliding latch mechanism as recited in claim 4 wherein the latch handle may be shifted from the first unlatched position to the second latched and locked position by operating the said lock means so the lock means may bypass the said shutter and the lock means may enter the slot means of the locking bar.

6. A two position three function sliding latch mechanism as recited in claim 5 wherein the said shutter is held by a lost motion connection to the locking bar, with tension spring means acting between the shutter and the locking bar for cocking the shutter when the latch handle is in its second latched but unlocked position.

7. A two position three function sliding latch mechanism as recited in claim 6 wherein the said operating means for the lock means includes an electroresponsive means that is connected to the said lock means for changing the position thereof.

* * * * *